United States Patent [19]

Penlesky et al.

[11] Patent Number: 4,867,640

[45] Date of Patent: Sep. 19, 1989

[54] EXHAUST FAN FOR BATHROOMS AND THE LIKE

[75] Inventors: Robert G. Penlesky, Waukesha; David W. Wolbrink; Kenneth J. Jonas, both of Hartford; Thomas A. Kuhnke, Campbellsport, all of Wis.

[73] Assignee: Broan Manufacturing Co., Inc., Hartford, Wis.

[21] Appl. No.: 76,323

[22] Filed: Jul. 22, 1987

[51] Int. Cl.[4] ..... F04D 29/62

[52] U.S. Cl. ..... 415/204; 415/214.1

[58] Field of Search ..... 415/201, 203, 204, 206, 415/207, 219 C; 417/353, 423 A

[56] References Cited

U.S. PATENT DOCUMENTS

| | | | |
|---|---|---|---|
| 2,710,573 | 6/1955 | Marker | 415/219 C X |
| 3,606,593 | 9/1971 | Steiner | 417/423 R |
| 3,698,833 | 10/1972 | Cann et al. | 415/219 C X |
| 3,732,030 | 5/1973 | Mullings | 415/219 C |
| 3,743,439 | 7/1973 | Cann | 415/206 |
| 3,926,537 | 12/1975 | Piper | 417/353 |
| 4,073,597 | 2/1978 | Barnhart et al. | 415/206 X |

FOREIGN PATENT DOCUMENTS

| | | | |
|---|---|---|---|
| 1234767 | 10/1960 | France | 415/219 C |

*Primary Examiner*—Robert E. Garrett
*Assistant Examiner*—Joseph M. Pitko
*Attorney, Agent, or Firm*—Andrus, Sceales, Starke & Sawall

[57] ABSTRACT

An improved fan of the centrifugal type for bathrooms and the like has a housing with a base wall and four depending side walls. An exhaust outlet fitting in one of the walls has an integral centrifugal fan outlet cutoff. A venturi plate, positioned within the side walls and parallel but spaced from the base wall contains an inlet opening for the fan. The portion of the plate surrounding the opening is formed as a venturi. The inlet opening is spanned by a strut means to support the motor driving the centrifugal impeller. The struts have a generally T-shaped configuration so as to be removed from the portion of the opening adjacent the exhaust outlet fitting, thereby to enhance the efficiency of the fan. The base wall and one of the sidewalls contains reinforced holes for receiving the wiring. A flap in the housing covers the one of the holes not used for wiring connection purposes. The holes are located adjacent a corner of the housing and a corner separator separates the holes, flap, and associated wiring from the remainder of the housing.

22 Claims, 3 Drawing Sheets

18
34
16

10
70
126
35
128
34
14
14
35
14
12

20
148
30
20
34
160
106
37
160
34
128
152
28
154
6
32
108
126
130
4
4
64
6
50b
50a
80
146
102
106
104
144
160
50b
160
66
16
22
26
64
50a
52
42

EXHAUST FAN FOR BATHROOMS AND THE LIKE

The present invention relates to improved exhaust fans of the centrifugal type. Such fans are typically utilized to ventilate bathrooms and other living spaces in homes.

The improved fan of the present invention has a housing with a base wall. When the fan is typically installed on a joist above the ceiling of the bathroom, the base wall forms the top of the housing. Four side walls depend from the base wall. A baffle is positioned within the side walls to form a centrifugal fan scroll. One of the side walls has an exhaust port containing an exhaust outlet fitting.

In accordance with one aspect of the present invention, a venturi plate is positioned within the side walls to lie parallel to, but spaced from, the base wall so as to form a blower chamber for the fan. The venturi plate contains an inlet air opening. The portions of the venturi plate surrounding the opening are formed as a venturi leading into the blower chamber.

A strut means formed in the venturi plate spans the inlet air opening for mounting the fan motor. A centrifugal fan impeller is mounted on the output shaft of the motor so as to lie within the blower chamber. The strut means has a configuration resembling a shallow Y and is positioned in the opening so as to be removed from the portion of the opening adjacent the exhaust port, thereby to enhance the efficiency of the fan.

The venturi plate is retained in the housing, without the use of fasteners, by peripheral tabs that engage slots in the side walls of the housing. The venturi plate may be easily inserted and removed from the fan by use of the tabs and slots to permit wiring and for other reasons.

To enhance the ease and versatility of the installation of the improved fan of the present invention, the base wall and one of the side walls have reinforced holes for receiving a wiring conduit connector or other appliance used to connect the fan to the household wiring. Depending on whether the fan is to be wired from the top or the side, one or the other of the holes is utilized. The hole not utilized is covered by a flap, preferably formed as a portion of the housing. The use of knock-outs is thus avoided, while at the same time the fan is capable of being wired from either the top or side.

The reinforced holes are preferably located in a corner of the housing.

A corner separator separates the parts of the base wall and side wall with the reinforced holes from the remainder of the blower chamber. The wiring connections for the fan are contained in the portion of the housing so separated. The motor is connected by means of a conventional two-prong plug and receptacle, the receptacle being mounted in the corner separator and connected to the wiring.

In accordance with another aspect of the claimed invention, the exhaust outlet fitting contains an integral centrifugal fan outlet cutoff that enhances the operation of the centrifugal blower by providing a smooth air flow transition and reduced feedback. The exhaust outlet fitting is removably mounted in the exhaust port for ease of assembly and repair.

The bath fan of the present invention also lends itself to manufacture and assembly by programmable manipulators, and the like.

The invention will be further understood from the following detailed description taken in conjunction with the drawing in which.

Figure 1:
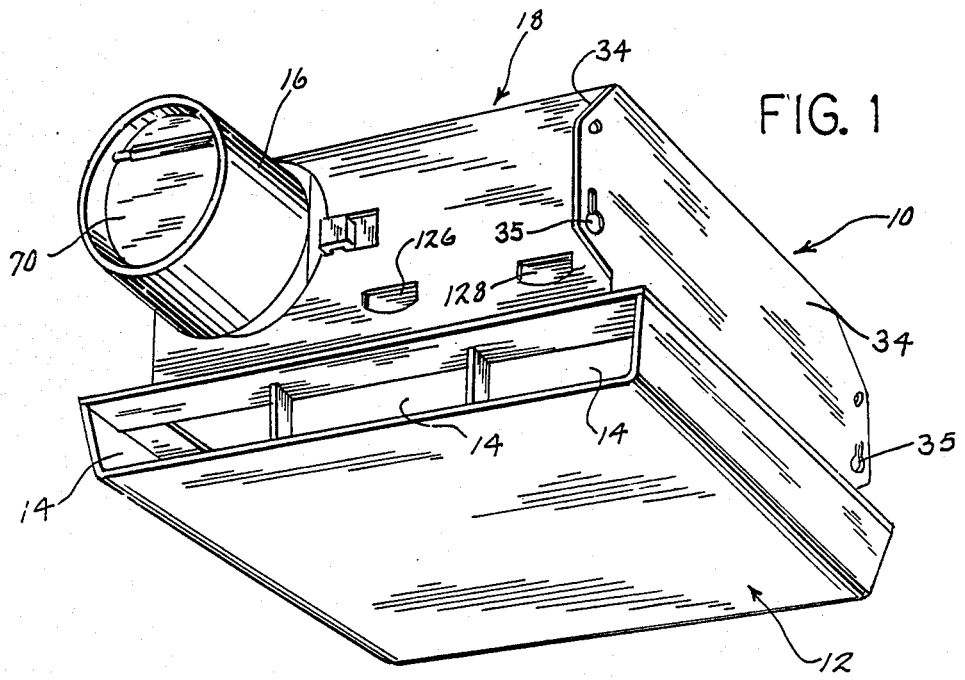
FIG. 1 is a perspective view of the improved fan of the present invention with a typical associated louver.

FIG. 1 shows fan 10 attached to louver 12. In use, fan 10 can be conveniently mounted in either the horizontal or vertical positions. Thus fan 10 is fastened along one side to a ceiling joist or subjoist or to a wall stud. Louver 12 extends below the ceiling or beyond the wall of a bathroom or other space. Fan 10 draws air in vents 14 of louver 12 and discharges it out exhaust outlet fitting 16.

Figure 3:
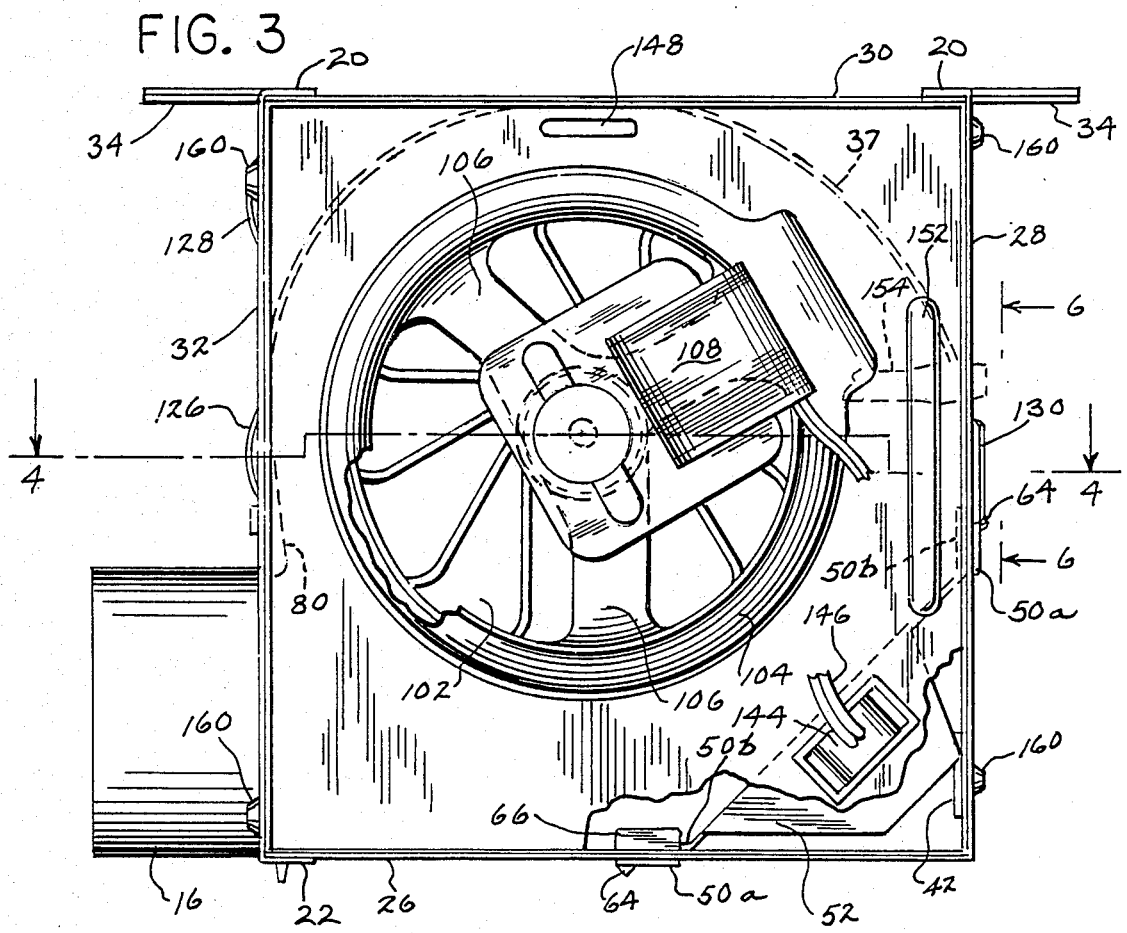
FIG. 3 is a bottom view of the fan, i.e. a view looking upward in FIG. 1, but with the louver removed.
Figure 2:
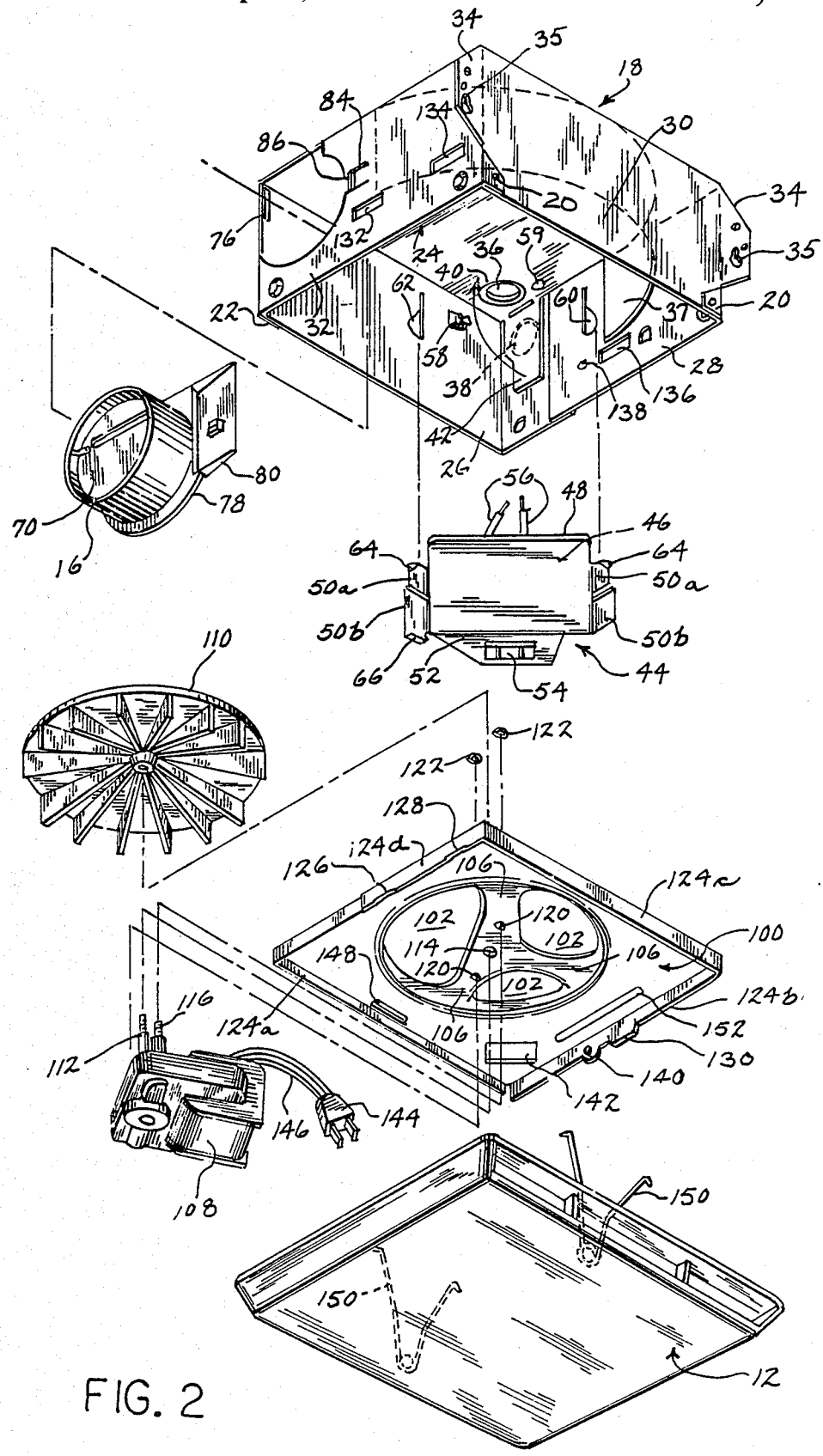
FIG. 2 is an exploded view of the fan.
Figure 4:
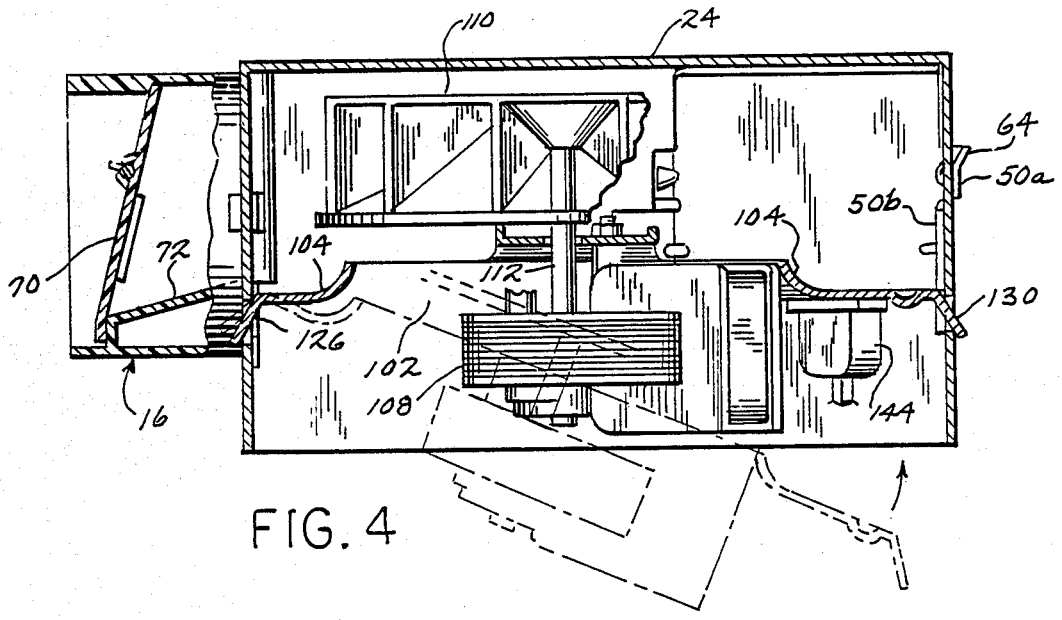
FIG. 4 is a cross sectional view along line 4—4 of FIG. 3, the manner of assembly of a portion of the fan being shown in phantom.

Fan 10 includes housing 18. Housing 18 is formed of sheet metal or other suitable material of a thickness sufficient to provide the necessary structural strength to fan 10. The sheet is bent to the configuration shown in the figures and fastened at overlapping corner flanges, such as 20 and 22, and elsewhere, by any suitable means. Housing 18 has base wall 24 forming a top wall when fan 10 is oriented as shown in FIGS. 1, 2, and 4. Four side walls 26, 28, 30, and 32 depend from base wall 24. Side wall 30 contains integral flanges 34 by which housing 18 may be mounted to a joist or stud as by nails or screws extending through holes 35. The adjacent ends of side walls 28 and 32 may be bent to be along flanges 34, thereby to provide a strengthening double thickness to the flanges, as shown in FIG. 3. The integral flanges assist in installing fan 10.

Housing 18 has curved sheet 37 fastened to walls 28, 30, and 32 that serves to form a centrifugal fan spiral or scroll in housing 18.

In accordance with one aspect of the present invention, housing 18 is so formed to provide ease and versatility to the installation of fan 10 and particularly the wiring thereof. Fan 10 may be connected, without knockouts, to a wire cable or conduit containing wire either from the top or the side. To this end, housing 18 has hole 36 in a base wall 24. When fan 10 is oriented as shown in FIGS. 1, 2 and 4, hole 36 accommodates a downwardly extending conduit or wire cable. Hole 38 is provided in side wall 28 to accommodate a horizontally extending conduit or wire cable. Each of holes 36 and 38 is provided with an annular reinforcing flange 40 for coaction with the wiring coupling to provide the necessary structural strength to the wiring-housing connection, and as required by various electrical codes. The annular flanges, such as that indicated by 40 in conjunction with hole 36 in FIG. 2, may be formed by folding back material from the center of the hole along the periphery of the hole to provide an additional thickness of the sheet material forming housing 18.

To close off the hole 36 or 38 not being used, flap 42 is provided in the sheet of material from which housing 18 is formed. During assembly of housing 18, flap 42 is bent to lie inside the housing, as shown in FIG. 2. If hole 36 is used to connect the wiring, flap 42 remains in the position shown in FIG. 2 to cover hole 38. If hole 38 is used to connect the wiring, flap 42 is bent to over hole 36, as shown by the arrow in FIG. 2.

Through the above-described arrangement, wiring connection in either the vertical or horizontal direction can be made to fan 10, thereby facilitating installation of the fan. The use of knock-outs can be avoided, while at the same time, the unused opening in housing 18 is closed to retain the closure integrity of housing 18, also as required by various electrical codes.

The corner of housing 18 containing holes 36 and 38 is separated from the remaining portions of housing 18 by corner separator 44. Corner separator 44 has vertical wall 46 lip or, flange 48, split vertical side flanges 50*a* and 50*b* on either side, and horizontal flange 52. Flange 52 mounts a conventional two-prong electrical receptacle 54 with lead wires 56.

After connection of housing 18 to the household wiring, the household wires are connected to lead wires 56 in a suitable manner, as by the use of twist connectors or the like. The ground wire of the household wiring may be connected to the adjacent portions of housing 18 by grounding clip 58 mounted on wall 26. Or, the ground wire may be connected to housing 18 by a grounding screw inserted into extruded hole 59 in base wall 24.

Figure 6:
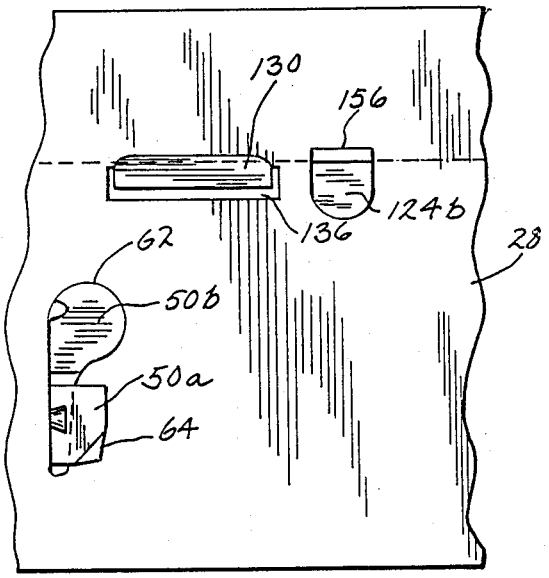
FIG. 6 is a fragmentary side view taken along the line 6—6 of FIG. 3.

Walls 26 and 28 are provided with somewhat drop shaped slots 60 and 62 for mounting corner separator 44 in housing 18. Side flanges 50*a* on either side of vertical wall 46 are inserted through slots 60, 62 by means of bent corners 64 so as to lie on the outer surface of side walls 28 and 26, as shown in FIGS. 3, 4 and 6. Side flanges 50*b* remain on the inside of sidewalls 38 and 26, as shown in FIGS. 4 and 6. The wiring connections are thus neatly separated from the remaining portions of the interior of housing 18 and the spiral or scroll configuration of the housing maintained. As fan 10 is customarily shipped with corner separator 14 assembled, one of side flanges 50*b* is provided with tab 66 that facilitates removal of separator 44 prior to connection to the wiring.

Corner separator 44 also serves to maintain flap 42 in the desired position. When flap 42 is in the position shown in FIG. 2, the flap is retained by horizontal flange 52 in the manner shown in FIG. 3. For this purpose, flap 42 is longer than vertical wall 46. When flap 42 is bent to be along base wall 24, it fits between flange 48 of corner separator 44 and base wall 24 when corner separator is installed.

Figure 5:
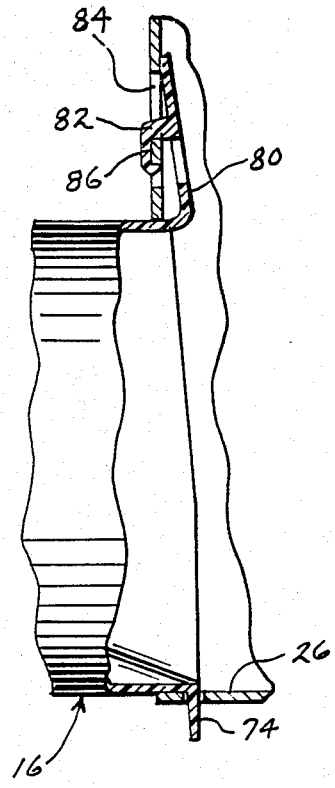
FIG. 5 is a fragmentary cross sectional view showing the discharge conduit fitting and associated portions of the housing.

Exhaust outlet fitting 16 may be made from plastic or other suitable material. Exhaust outlet fitting 16 includes damper 70 for preventing reverse flow of air into fan 10. Exhaust outlet fitting 16 also includes baffle 72, shown most clearly in FIG. 4 that matches the configuration of the inlet end of fitting 16 to that of the venturi plate, hereinafter described, when the latter is installed in housing 18. The inlet end of fitting 16 includes flange 74 that fits in slot 76 in housing wall 26, as shown in FIGS. 2 and 5 to retain one side of exhaust outlet fitting 16 in the housing. Exhaust outlet fitting 16 also includes sealing flange 78 adjacent the inlet end. Flange 78 includes integral outlet cutoff 80 for the spiral or scroll of the centrifugal blower, as shown most clearly in FIG. 5. Such a configuration assists in forming a smooth scroll for the fan, lessens feedback and enhances the operation of the centrifugal fan. Outlet fitting 16 is conveniently retained in the exhaust port of housing 18 by clip 82 that passes through opening 84 in wall 32. With flange 74 in slot 76, clip 82 is slid sideways in the opening 84 so that the hooked end of the clip engages bar 86 to retain the fitting in housing 18.

As noted above, curved sheet 37, fastened to walls 28, 30, and 32 forms a centrifugal blower spiral or scroll in housing 18 extending from outlet cutoff 80. Vertical wall 46 of corner separator 44 and a portion of wall 26 also form the scroll, as shown most clearly in FIG. 3.

Housing 18 is spanned by venturi plate 100 that provides both an air inlet for the fan and supports the blower motor. Venturi plate 100 contains inlet opening 102 that connects vents 14 of louver 12 to the blower chamber formed between plate 100 and base wall 24 of housing 18. The periphery of opening 102 is formed as an inlet venturi to the chamber by flange 104, as shown most clearly in FIG. 4.

A plurality of struts 106 span opening 102 to support motor 108 for blower impeller 110. As shown in FIG. 3, struts 106 are positioned to avoid the area of outlet cutoff 80, thereby to avoid any reduction in the efficiency of the blower. To this end, the struts have the configuration of a shallow Y or T, as shown in FIGS. 2 and 3. The output shaft 112 of motor 108 extends through hole 114 in struts 106 to receive impeller 110. The motor is mounted to struts 106 by bolts 116. Bolts 116 extend through holes 120 in struts 106 to receive nuts 122.

Venturi plate 100 has peripheral flanges 124*a–d*. Flange 124*d* includes a pair of tabs 126 and 128 and flange 124*b* includes tab 130. Tabs 126 and 128 engage slots 132 and 134 in wall 32 and tab 130 engages slot 136 in wall 28 to position venturi plate in housing 18. Venturi plate 100 is installed by inserting tabs 126 and 128 in slots 132 and 134, as shown in phantom in FIG. 4. Venturi plate 100 is then swung in the direction of the arrow in FIG. 4 until tab 130 lodges in slot 136. Flanges 124*a–d* lie proximate to side walls 26–32. Tabs 126, 128 and 130 and slots 132, 134, and 136 fully secure venturi plate 100 in housing 20, since the weight of motor 108 serves to retain the tabs in the slots. However, a retaining screw may be inserted in holes 138 and 140 of wall 28 and flange 124*b*, if desired.

Venturi plate 100 includes opening 142 that exposes receptacle 54 in horizontal flange 52. Motor 108 is connected to the lead wires 56 by inserting plug 144 on lead wires 146 into the receptacle, as shown in FIGS. 3 and 4. Venturi plate 100 assists in retaining corner separator 44 in housing 18.

Venturi plate 100 also includes slots 148 that engage spring wires 150 for holding louver 12 on fan housing 18.

A stiffening ridge 152 is provided on venturi plate 100 adjacent tab 130. Venturi plate 100 may be pushed up, when viewed as in FIG. 4, and wall 28 bowed outwardly to remove tab 130 from slot 136 to release venturi plate 100 from the housing to permit wiring of fan 10 and for other reasons. Or, a screwdriver 154 shown in FIG. 3 may be inserted in opening 156 against the edge of flange 124*b* and used as a lever or pry bar to release the tab from the slot. Side walls 28 and 32 contain projections 160 adjacent the ends thereof, as shown most clearly in FIG. 3. The projections may be in the form of extruded holes. They serve to space the plaster board of the ceiling or wall from the side walls so that the walls can flex to release the venturi plate.

Various modes of carrying out the invention are contemplated as being within the scope of the following claims particularly pointing and distinctly claiming the subject matter which is regarded as the invention.

We claim:

1. A fan comprising:

a housing having a base wall with four side walls attached thereto;

baffle means positioned within said side walls to form at least a portion of a centrifugal fan scroll;

exhaust outlet means in one of said side walls;

a venturi plate positioned within said side walls and lying parallel to, but spaced from, said base wall to form a blower chamber containing said fan scroll, said venturi plate containing an opening, the portion of said venturi plate surrounding said opening being formed as a venturi leading into said blower chamber, said venturi plate having strut means spanning said opening so as to be removed from the portion of said opening adjacent said exhaust outlet means, said strut means being formed of portions of said plate and being integral with said plate;

a centrifugal blower impeller in said blower chamber positioned in alignment with said opening for drawing air through said opening and discharging same through said exhaust outlet means; and a motor mounted on said strut means having an output shaft on which said impeller is mounted.

2. The fan according to claim 1 wherein said strut means has a generally T or shallow Y-shaped configuration.

3. The fan according to claim 1 wherein said motor is mounted on said venturi plate outside said slower chamber.

4. The fan according to claim 1 wherein said venturi plate is removably mounted on said side walls.

5. The fan according to claim 4 wherein said venturi plate has tabs insertable in slots in said side walls for removably mounting said venturi plate on said side walls.

6. The fan according to claim 5 wherein said tabs are mounted on opposing edges of said venturi plate and said slots are located in opposing side walls of said housing.

7. The fan according to claim 5 wherein said venturi plate has a peripheral flange containing said tabs and wherein one of said side walls contains an opening exposing a portion of said flange adjacent one of said tabs, a lever being insertable in said opening to remove the tab from the slot to permit removal of the venturi plate from the housing.

8. The fan according to claim 5 wherein said side walls are flexible to permit the insertion and removal of said tabs into and from said slots, at least one of said side walls containing said slots having means for spacing adjacent building elements from said side wall by an amount permitting said side wall to flex to the extent necessary to insert or remove a tab to or from a slot.

9. The fan according to claim 1 wherein said housing is couplable to an inlet louver and wherein said venturi plate includes means for coupling the inlet louver to said housing.

10. The fan according to claim 1 wherein said base wall and side walls are formed of sheet material and wherein said housing has flanges for mounting the fan, said flanges having a double thickness of sheet material.

11. A fan suitable for connections to wiring means and comprising:

a housing having a base wall with four side walls attached thereto, the wiring means running generally normal to said base wall or to one of said side walls; said housing having holes for receiving the wiring means in said base wall and in said one of said side walls, and a flap of said housing positionable to cover one or the other of said holes;

exhaust outlet means in one of said side walls;

a venturi plate positioned within said side walls and lying parallel to, but spaced from, said base wall to form a blower chamber, said venturi plate containing an inlet opening; and a motor driven centrifugal blower impeller in said occurence chamber for drawing air through said inlet opening and discharging same through said exhaust outlet means.

12. The fan according to claim 11 wherein said flap is integrally formed with said base wall of said housing and is bendable with respect thereto.

13. The fan according to claim 11 wherein the edges of said holes are reinforced.

14. The fan according to claim 11 wherein said holes are located adjacent a corner of said housing and wherein said fan includes a corner separator separating said corner from said blower chamber.

15. The fan according to claim 14 wherein said separator includes a portion normal to said base wall and coacting with said side walls for separating off said corner.

16. A fan according to claim 14 wherein said separator is so positioned as to coact with said flap to retain said flap in the desired position.

17. The fan according to claim 14 wherein said separator is removably mounted on the housing adjacent said corner.

18. The fan according to claim 14 wherein said separator has side flanges engageable with slots in said side walls for removably mounting said separator on said side walls.

19. The fan according to claim 14 wherein said separator includes electrical connection means for connecting a motor for said impeller to said wiring means.

20. The fan according to claim 11 further including a baffle means positioned within said side walls to form at least a portion of a centrifugal fan scroll.

21. The fan according to claim 11 wherein said base wall and side walls are formed of sheet material and wherein said housing has flanges for mounting the fan, said flanges having a double thickness of said sheet material.

22. A fan comprising:

a housing having a base wall with four side walls attached thereto;

a baffle positioned within said side walls to form at least a portion of a centrifugal fan scroll having a discharge end;

an exhaust outlet means having a centrifugal fan outlet cutoff formed integrally therewith, said outlet means and cutoff being removably mounted on a side wall of said housing proximate the discharge end of said scroll, said mounting being such that said outlet means and cutoff can be removed from said side wall by withdrawing same into the interior of said housing;

a venturi plate positioned within said side walls and lying parallel to, but spaced from, said base wall to form a blower chamber containing said fan scroll, said venturi plate containing an inlet opening; and a motor driven centrifugal fan impeller in said chamber for drawing air through said inlet opening and discharging same through said exhaust outlet means.

* * * * *